United States Patent [19]

Kozar

[11] Patent Number: 4,533,982

[45] Date of Patent: Aug. 6, 1985

[54] FLASHLIGHT WITH SWIVELLING HEAD

[76] Inventor: John J. Kozar, 11 St. - 5th Ave., New Kensington, Pa. 15068

[21] Appl. No.: 663,174

[22] Filed: Oct. 22, 1984

[51] Int. Cl.[3] ..... F21L 7/00

[52] U.S. Cl. ..... 362/183; 362/190; 362/191; 362/197; 362/199; 362/202; 362/205; 362/287; 362/398; 362/421; 362/427

[58] Field of Search ..... 362/183, 190, 191, 197, 362/199, 202, 205, 287, 398, 427, 421

[56] References Cited

U.S. PATENT DOCUMENTS 3,008,040 11/1961 Moore ..... 362/199

*Primary Examiner*—Stephen J. Lechert, Jr.
*Attorney, Agent, or Firm*—Harvey B. Jacobson

[57] ABSTRACT

A portable flashlight comprises an elongate battery casing and a swivelling flashlight head connected to one end of the casing through a ball-and-socket connection which forms part of the electrical circuit connecting the batteries to the flashlight bulb. A removable support pad is provided for attachment to an end cap of the casing for supporting the casing in vertical position while permitting swivelling movements of the flashlight head, and the casing further includes a transversely extending support pad for supporting the casing on its side and a magnetic assembly for magnetically attaching the casing to a support surface.

18 Claims, 8 Drawing Figures

FLASHLIGHT WITH SWIVELLING HEAD

BACKGROUND OF THE INVENTION

This invention relates to a flashlight with a swivelling head which can be moved through a wide angle, so that a light beam from the flashlight can be directed in different directions. Further, a flashlight in accordance with the invention is designed to be self-supporting in a variety of positions, so that a person using the flashlight can use both hands while accurately directing light to a required location. The dual facility of a self-supporting flashlight having a swivelling head thus provides an extremely versatile device beneficial to persons in diverse fields of work.

STATEMENT OF PRIOR ART

Applicant is aware of the following U.S. patents, the relevance of which is that they relate to swivelling head-type flashlights and the like. None of the patents, however, discloses a flashlight having the features of the present invention.

U.S. Pat. No. 1,617,793
U.S. Pat. No. 1,893,108
U.S. Pat. No. 1,689,457
U.S. Pat. No. 3,008,040.

SUMMARY OF THE INVENTION

A flashlight in accordance with the invention has a battery casing and a flashlight head with a light bulb, lens and reflector assembly, the flashlight head being connected to the battery casing by means of a swivel-type ball-and-socket connection.

In one aspect of the invention, an electrical circuit for providing electrical connection between a battery in the battery casing and the light bulb has a circuit portion which includes the ball and socket. For example, the battery casing may include a non-conducting mount for the socket, which is electrically conducting, with an electrical contact extending from the base of the socket through the mount to contact one of the battery terminals. The electrically conducting ball received in the socket may be connected to the flashlight head by a non-conducting plug which includes an electrically conducting sprung plunger for providing electrical connection between an arm carrying the ball and a base contact of the light bulb. The contact ring of the bulb may be connected through an on-off switch on the flashlight head to a return lead connected through the battery casing to the opposite battery terminal. This aspect of the invention affords a simple form of electrical circuitry for a swivelling head flashlight which provides electrical integrity of the circuit in all swivel positions of the flashlight head.

In another aspect of the invention, the battery casing may be of elongate cylindrical form, for example to accept plural size D standard 1.5 V flashlight batteries end-to-end, with a base cap at one end of the casing opposite the ball-and-socket connection, the base cap having an external connector for releasably attaching a support pad to the cap enabling the flashlight to be supported vertically on end on a suitable support surface, with the flashlight head being swivelled to any required orientation. The battery casing may further be provided with a transversely extending support pad adjacent the ball-and-socket connection for stabilizing and supporting the flashlight in horizontal position on a support surface while allowing swivelling adjustment of the head. Further, the casing may be provided with an intermediate magnetic assembly enabling the flashlight to be magnetically attached to a suitable support surface.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
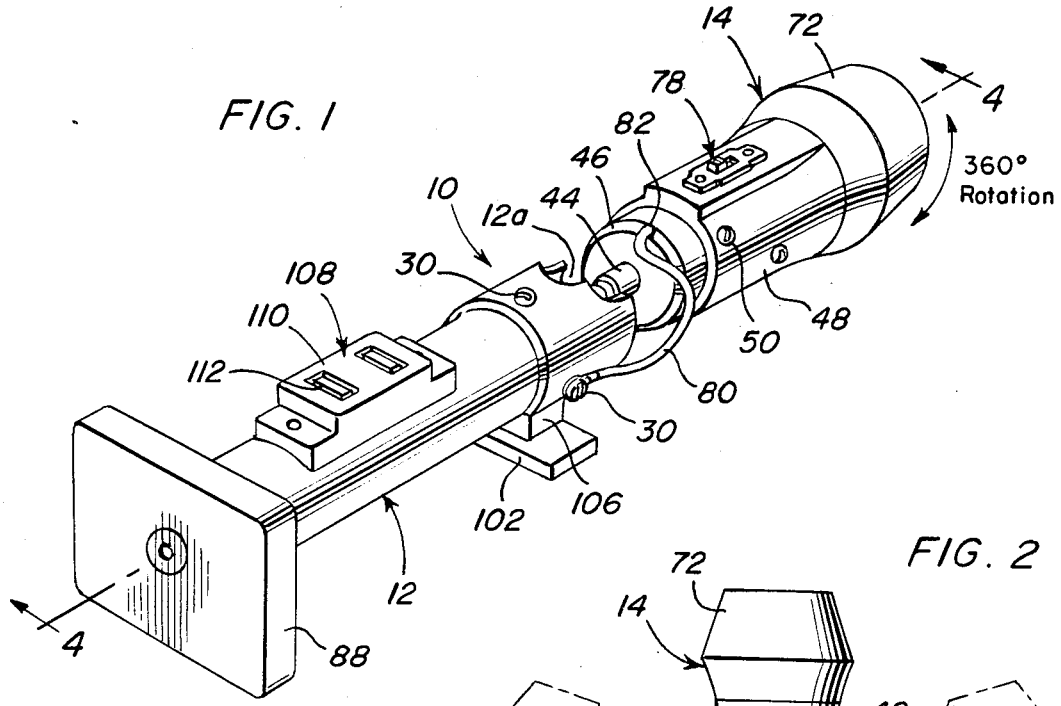
FIG. 1 is a perspective view of a flashlight in accordance with the invention.

The illustrated flashlight 10 comprises an elongate cylindrical battery casing 12 and a swivelling head 14 connected to one end of the battery casing by a ball and socket-type swivel connection, as will be described, enabling the head to be adjusted relative to the battery casing, so as to direct the light beam from the head in a required direction.

Casing 12 may be made of metal, and may, for example, be of a size to receive two size D standard 1.5 V flashlight batteries 16, 18 end to end in known manner. A removable screw-on cap 20 with an internal contact spring 22 may be provided for the base end of the casing. At its other end, casing 12 may receive a disc-like mount 24 of non-electrically conducting material, the mount having secured thereto by screw-and-nut assemblies 26, a yoke or saddle-like metallic socket 28 forming part of the swivel connection between casing 12 and head 14. Mount 24 may be releasably secured in the casing by radial screws 30 threaded into suitable holes in the mount. A metallic contact spring 32 may be soldered to the base of socket 28 and extends through a central bore 34 in mount 24 to contact positive terminal 36 of battery 18.

Socket 28 receives a metallic ball 38 forming the other part of the swivel connection between the battery casing and the head of the flashlight, with screw-and-nut assemblies 40 connecting opposite walls of the socket straddling the ball and providing a tightness adjustment for the ball. Ball 38 is provided with an electrically conducting arm 42 with a surrounding sleeve 44 inserted into the base of a plastic or like non-conducting plug 46 received in one end of a casing 48 of the flashlight head 14, and held in place by radial screws 50. Internally, plug 46 is formed with a cylinder 52 housing a plunger 54 with a stem 56 urged outwardly by a coil spring 58 forming an electrical connection between arm 42 and plunger 54.

The stem 56 of plunger 54 engages a contact 60 at the base of a plastic cup 62 housing a bulb 64, the bulb and cup being a push.fit into a contact ring 66 and concave reflector 68 pressed together to form a unit. Contact 60 touches the base terminal 64*a* of bulb 64 and ring terminal 64*b* of the bulb engages contact ring 66. Head 14 is provided with a conventional lens 70 on the reflector 68 and a screw-on cover 72 retaining the bulb assembly in the head while allowing for bulb replacement.

A leaf-type contact spring 74 secured internally in head 14 engages contact ring 66 and is connected to a lead 76 attached to one terminal 78*a* of a conventional on/off switch 78 suitably secured to head 14. The other terminal 78*b* of the switch is connected with a lead 80 extending through a bore 82 in plug 46, and connected to one of the screws 30 to complete the electrical circuit through casing 12. Contact spring 74 and switch 78 are received in pockets 46*a* and 46*b* formed in plug 46.

Figure 6:
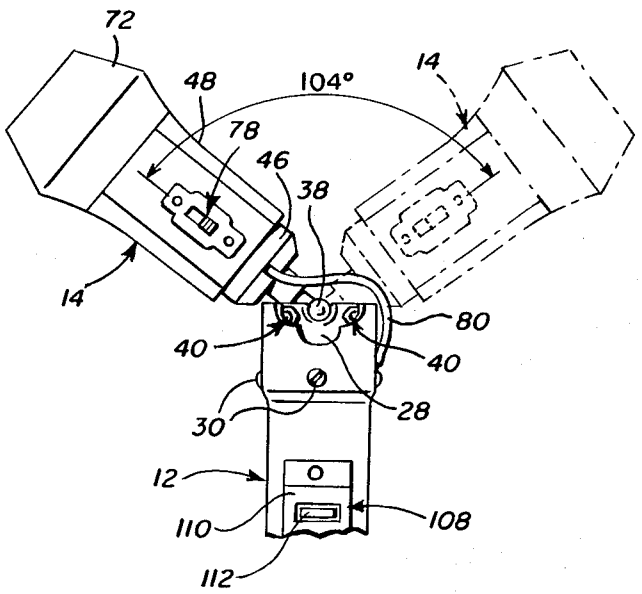
FIG. 6 is an elevational view of one end of the flashlight showing swivelling movements of the flashlight head in a second plane.

It will be noted from the foregoing that the flashlight has a simple electrical circuit extending from positive terminal 36 of battery 18 to base terminal 64*a* of bulb 64 through spring 32, socket 28, ball 38 and arm 42, spring 58, plunger 54 and stem 56, and contact 60, the circuit returning from bulb terminal 64*b* through contact ring 66, contact spring 74, lead 76, switch 78 and lead 80. Further, the live ball-and-socket connection provides integrity of the electrical circuit in all swivel positions of the flashlight head. The shape of socket 28 is such as to allow 180° swivelling of the head 14 in one plane lengthwise of the socket (FIGS. 2 and 4), casing 12 having cutouts 12*a* to accommodate such swivelling, and about 104° swivelling of the head in an orthogonal plane (FIGS. 5 and 6) transversely of the socket. Also, the head can be orbited through 360° as indicated in FIG. 1.

Figure 2:
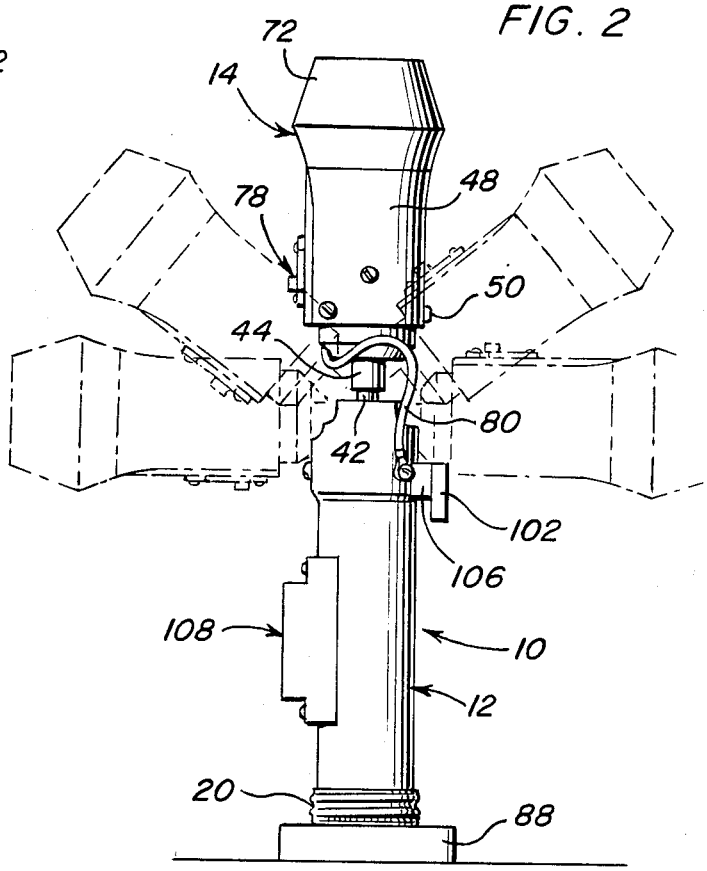
FIG. 2 is an elevational view of the flashlight standing on end on a support surface and showing swivelling movements of the flashlight head in a first plane.
Figure 8:
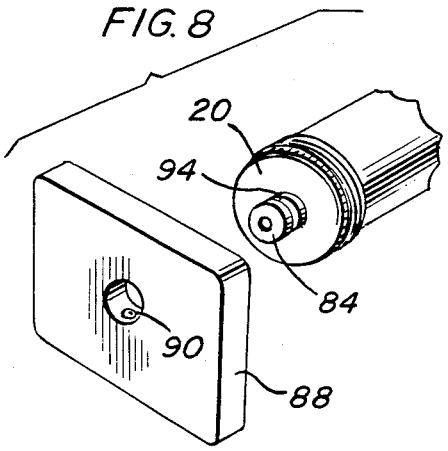
FIG. 8 is a perspective view of a base end of the flashlight showing a releasable support pad.
Figure 3:
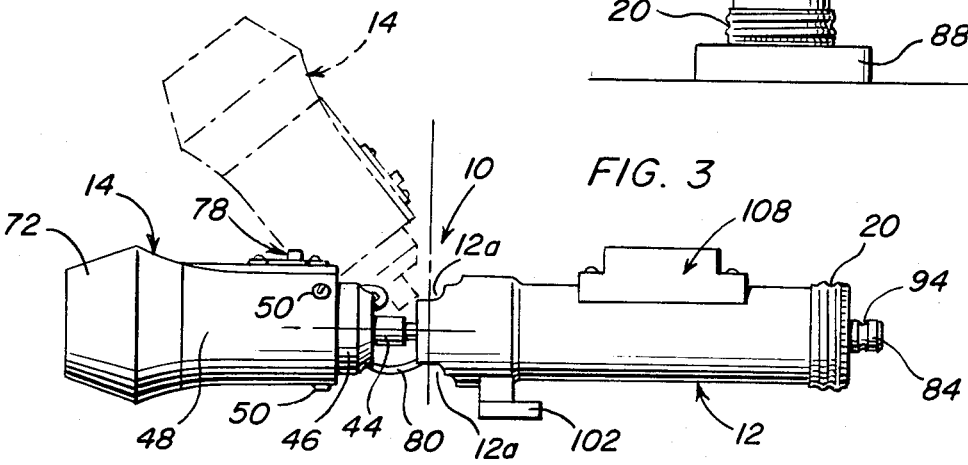
FIG. 3 is an elevational view of the flashlight disposed on its side.
Figure 4:
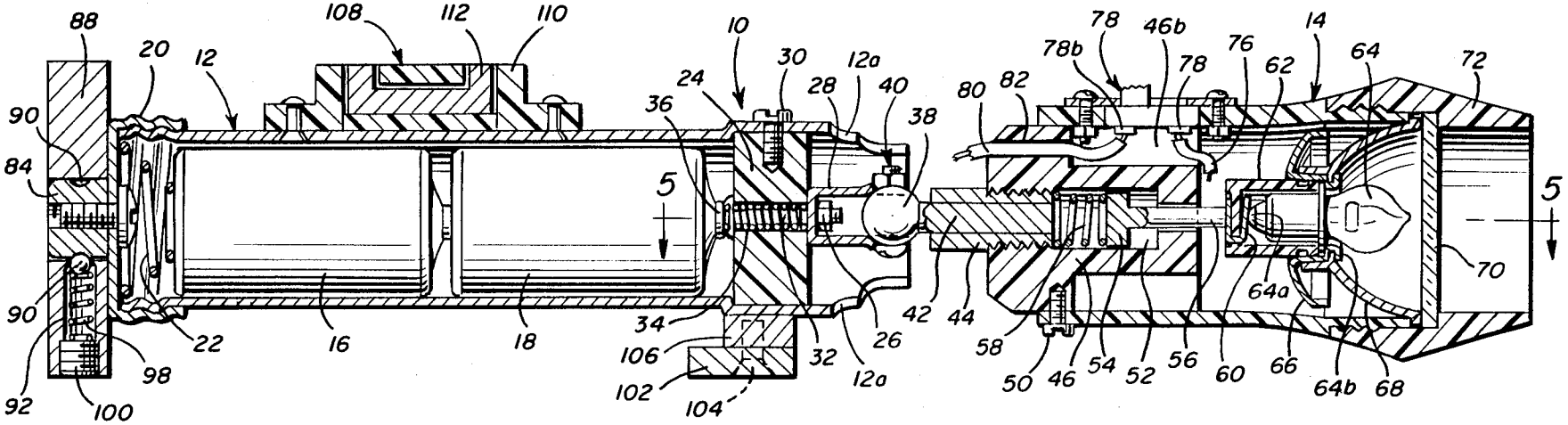
FIG. 4 is an enlarged sectional view of the flashlight.
Figure 5:
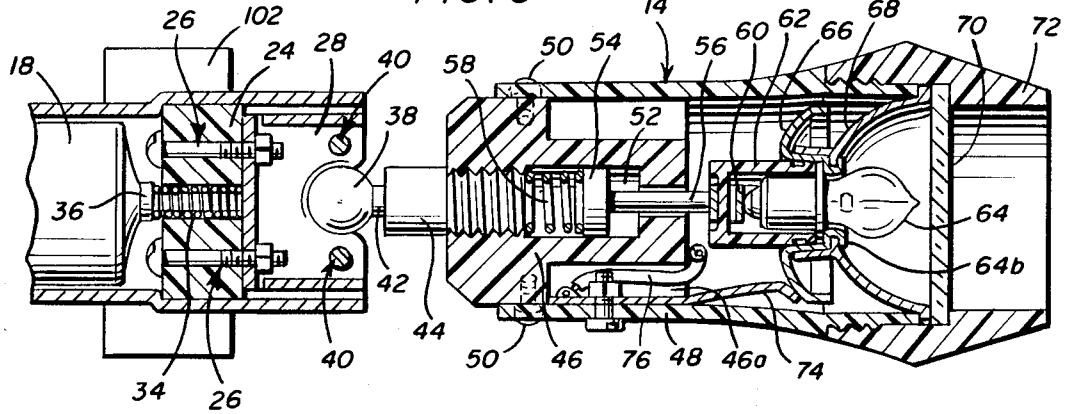
FIG. 5 is a sectional view on line 5—5 of FIG. 4.
Figure 7:
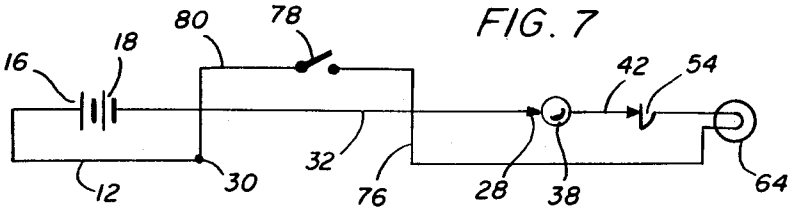
FIG. 7 is a circuit diagram for the flashlight.

In accordance with a further feature of the invention, the flashlight has provision for a number of support assemblies for supporting same in different orientations on suitable support surfaces while permitting adjustment of the flashlight head to any swivel position. Thus, screw-on cap 20 may, for example, be provided with an integral external post 84 threaded on a screw 86, for releasable receipt of a first support pad 88 which may be snapped onto and off the post by means of a sprung detent ball 90 extending from a bore 92 in the pad, and which engages a circumferential groove 94 in the post. Ball 92 may be held at the end of a passage 96 formed in the pad by a spring 98 and a cap screw 100. Pad 88 may be used, for example, for stabilized support of the flashlight on its end, as shown in FIG. 2. Additionally, casing 12 may be provided with a transverse support pad 102 at its upper end for use in supporting the flashlight in horizontal position, with or without pad 88 being secured in place, as shown in FIGS. 1, 3 and 4. Pad 102 may be secured by screws 104 to a spacer 106 suitably attached to or integrally formed on casing 12. Further, casing 12 may be provided with a magnet assembly 108 comprising a housing 110 riveted to the casing and including a powerful permanent magnet 112 for attaching the flashlight to magnetic surfaces.

It will be seen from the foregoing that the invention provides a swivelling head flashlight having an extremely simple form of electric circuit and which can be supported in various orientations allowing swivelling movement of the flashlight head to an infinite number of positions, so that the flashlight can be used to advantage in a self-supporting manner in diverse situations.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A portable flashlight comprising a battery casing, a flashlight head with a light bulb, lens and reflector assembly, and an electrically conducting ball-and-socket assembly forming a swivel connection between the battery casing and the head and also providing electrical connection between the battery casing and the head as part of an electrical circuit for connecting a battery in the casing with the light bulb.

2. The invention of claim 1 wherein the socket is secured to a mounting piece received in a cylindrical terminal portion of the battery casing with the socket and casing being mutually configured to allow swivelling of the ball in a manner providing substantially 180° movement of the flashlight head in one plane, less than 180° movement of the flashlight head in an orthogonal plane, and 360° orbital movement of the flashlight head.

3. The invention of claim 1 wherein the socket is secured to a non-conducting mounting piece received in the battery casing with an electrically conducting contact member extending from the socket through the mounting piece for contacting one terminal of a battery in the casing.

4. The invention of claim 3 wherein the contact member comprises a coil spring.

5. The invention of claim 3 wherein the ball includes an electrically conducting arm extending into one end of a non-conducting plug received in the flashlight head, the plug further including electrical connector means for providing electrical connection between the arm and one terminal of the flashlight bulb.

6. The invention of claim 5 wherein the connector means includes a plunger in the plug having an elongate extension projecting from the opposite end of the plug and a spring interposed between the arm and the plunger in a plunger chamber formed in the plug for urging the plunger extension toward a base terminal of the bulb.

7. The invention of claim 6 wherein the bulb, lens and reflector assembly includes a bulb-receiving cup with a spring contact in the base thereof for providing electrical connection between the plunger extension and the base terminal of the bulb.

8. The invention of claim 7 wherein the flashlight head includes an internal contact for providing electrical connection between a ring terminal of the bulb and a return portion of the electrical circuit including an on-off switch.

9. The invention of claim 8 wherein the switch is mounted on the flashlight head, and a return lead extends from the switch through the plug to a ground connection on the battery casing.

10. The invention of claim 1 wherein the battery casing is of elongate cylindrical form with said ball-and-socket connection at one end thereof and a removable battery-retaining and electrical contact-forming cap at the other end thereof.

11. The invention of claim 10 wherein the cap includes an attachment means for a removable support pad for supporting the battery casing on its end while permitting swivelling movements of the flashlight head.

12. The invention of claim 11 wherein the battery casing includes a transversely extending support pad adjacent the swivel connection for supporting the battery casing on its side while permitting swivelling movements of the flashlight head.

13. The invention of claim 12 including a magnet assembly on the battery casing for supporting same on a magnetic surface.

14. A portable flashlight comprising an elongate cylindrical battery casing, a flashlight head having a light bulb, lens and reflector assembly, a ball-and-socket assembly forming a swivel connection between the battery casing and the head at one end of the casing, circuit mens for providing electrical connection between a battery in the battery casing and the bulb throughout a swivelling range of the flashlight head, and a support pad for the opposite end of the casing for supporting the casing on end while permitting swivelling movements of the flashlight head.

15. The invention of claim 14 wherein the support pad has a releasable connection with a removable battery-retaining and electrical contact-forming end cap fitting on said opposite end of the casing.

16. The invention of claim 15 wherein the end cap has an outwardly projecting post for receiving the support pad and the pad has spring detent means for retaining same on the post by engaging a circumferential groove on the post.

17. The invention of claim 14 wherein the battery casing includes a further transversely extending support pad adjacent said one end thereof for supporting the casing on its side while permitting swivelling movements of the head.

18. The invention of claim 14 wherein the battery casing includes a magnet fitting for magnetically attaching the casing to a magnetic surface.

* * * * *